US008059824B2

(12) United States Patent
Pallone et al.

(10) Patent No.: US 8,059,824 B2
(45) Date of Patent: Nov. 15, 2011

(54) JOINT SOUND SYNTHESIS AND SPATIALIZATION

(75) Inventors: Grégory Pallone, Trelevern (FR); Marc Emerit, Rennes (FR); David Virette, Pleumeur Bodou (FR)

(73) Assignee: France Telecom, Paris (FR)

( * ) Notice: Subject to any disclaimer, the term of this patent is extended or adjusted under 35 U.S.C. 154(b) by 688 days.

(21) Appl. No.: 12/225,097

(22) PCT Filed: Mar. 1, 2007

(86) PCT No.: PCT/FR2007/050868

§ 371 (c)(1),
(2), (4) Date: Oct. 24, 2008

(87) PCT Pub. No.: WO2007/104877

PCT Pub. Date: Sep. 20, 2007

(65) Prior Publication Data

US 2009/0097663 A1 Apr. 16, 2009

(30) Foreign Application Priority Data

Mar. 13, 2006 (FR) ..... 06 02170

(51) Int. Cl.
*H04S 1/00* (2006.01)
*H04R 5/00* (2006.01)

(52) U.S. Cl. ..... 381/1; 381/2; 381/20
(58) Field of Classification Search ..... 381/1–20
See application file for complete search history.

(56) References Cited

U.S. PATENT DOCUMENTS

| | | | | |
|---|---|---|---|---|
| 5,500,900 | A | 3/1996 | Chen et al. | |
| 5,596,644 | A | 1/1997 | Abel et al. | |
| 2006/0085200 | A1* | 4/2006 | Allamanche et al. | 704/500 |
| 2008/0008323 | A1* | 1/2008 | Hilpert et al. | 381/1 |
| 2010/0177903 | A1* | 7/2010 | Vinton et al. | 381/20 |
| 2011/0075848 | A1* | 3/2011 | Purnhagen et al. | 381/2 |

FOREIGN PATENT DOCUMENTS

FR 2679689 A1 1/1993

(Continued)

OTHER PUBLICATIONS

Doctoral Thesis of Jerome Daniel, "Representation de champs acoustiques, application a la transmission et a la reproduction de scenes sonores complexes dans un contexte multimedia".

(Continued)

*Primary Examiner* — Cuong Q Nguyen
(74) *Attorney, Agent, or Firm* — McKenna Long & Aldridge LLP

(57) ABSTRACT

The invention concerns a process for joint synthesis and spatialization of multiple sound sources in associated spatial positions, including: a) a step of assigning to each source at least one parameter ($p_i$) representing an amplitude; b) a step of spatialization consisting in implementing an encoding into a plurality of channels, wherein each amplitude ($p_i$) is duplicated to be multiplied to a specialization gain ($g_i^m$), each spatialization gain being determined for one encoding channel ($p_g^m$) and for a source to be spatialized ($S_i$); c) a step of grouping (R) the parameters multiplied by the gains ($P_i^m$), in respective channels ($p_g^1, \ldots, p_g^M$), by applying a sum of said multiplied parameters ($p_i^m$) on all the sources ($S_i$) for each channel ($p_g^m$), and d) a step of parametric synthesis (SYNTH (I), . . . , SYNTH(M)) applied to each of the channels ($p_g^m$).

9 Claims, 4 Drawing Sheets

FOREIGN PATENT DOCUMENTS

| | | | |
|---|---|---|---|
| FR | 2782228 | A1 | 2/2000 |
| FR | 2851879 | A | 9/2004 |
| WO | WO 2005069272 | A1 | 7/2005 |

OTHER PUBLICATIONS

Jerome Daniel, "Spatial Sound Encoding Including Near Field Effect: Introducing Distance Coding Filters and a Viable, New Ambisonic Format".

Doctoral Thesis of G. Pallone, << Dilatation et transposition sous contraintes perceptives des signaux audio: Application au transfert cinema-video >>.

Smith J.O., "Viewpoints on the History of Digital Synthesis", Proceedings of the International Computer Music Conference (ICMC-91, Montreal), pp. 1-10, Computer Music Association, Oct. 1991. Revised with Curtis Roads for publication in Cahiers de I'IRCAM, Sep. 1992, Institut de Recherche et Coordination Acoustique / Musique.

Roads Curtis, John Strawn., "The Computer Music Tutorial", The MIT Press, 1996 The Computer Music Tutorial, ISBN 0262680823, 9780262680820-1234 pages. *See Internet*: http://mitpress.mitedu/cataloghtem/default.asp?ttype=2&tid=8218 Short explanation: *The Computer Music Tutorial* is a comprehensive text and references that covers all aspects of computer music, including digital audio, synthesis techniques, signal processing, musical input devices, performance software, editing systems, algorithmic composition, MIDI, synthesizer architecture, system interconnection, and psychoacoustics, A special effort has been made to impart an appreciation for the rich history behind current activities in the field. Profusely illustrated and exhaustively referenced and cross-referenced, *The Computer Music Tutorial* provides a step-by-step introduction to the entire field of computer music techniques. Written for nontechnical as well as technical readers, it uses hundreds of charts, diagrams, screen images, and photographs as well as clear explanations to present basic concepts and terms. Mathematical notations and programs code examples are used only when absolutely necessary. Explanations are not tied to any specific software or hardware.

denBrinker A.C., Schuijers E.G.P., Oomen A.W.J. "Parametric coding for High-Quality Audio". 112$^{th}$ AES convention, Munich, Germany, 2002.

Szczerba M., Oomen A.W.J., Middelink M.K. "Parametric Audio Coding Based Wavetable Synthesis". 116$^{th}$ AES convention, Berlin, Germany, 2002.

* cited by examiner $ss^1(\omega)$
$ss^m(\omega)$
$ss^M(\omega)$
$env_1(\omega)$
$env_K(\omega)$
$P^1_{g,1}$
$P^1_{g,K}$
$P^M_{g,1}$
$P^M_{g,K}$
$k\in[1,K]$
$m\in[1,M]$
$P^1_{1,1}$
$P^M_{1,1}$
$P^1_{1,K}$
$P^M_{1,K}$
$P^1_{N,1}$
$P^M_{N,1}$
$P^1_{N,K}$
$P^M_{N,K}$
$g^1_1$
$g^M_1$
$g^1_N$
$g^M_N$
$P_{1,1}$
$P_{1,K}$
$P_{N,1}$
$P_{N,K}$
$(s_1)$
$(s_N)$
$i\in[1,N]$

JOINT SOUND SYNTHESIS AND SPATIALIZATION

This application is a 371 national stage entry of International Application No. PCT/FR2007/050868, filed Mar. 1, 2007 and claims priority to French Patent Application No. 06 02170, filed on Mar. 13, 2006, both of which are hereby incorporated by reference in their entirety.

BACKGROUND OF THE INVENTION

The present invention relates to an audio processing and, more particularly, a three-dimensional spatialization of synthetic sound sources.

Currently, the spatialization of a synthetic sound source is often performed without taking account of the sound production mode, that is, of the way in which the sound is synthesized. Thus, many models, notably parametric, have been proposed for the synthesis. In parallel, numerous spatialization techniques have also been proposed, without, however, proposing a cross-check with the technique chosen for a synthesis.

Known among the synthesis techniques are the so-called "non-parametric" methods. No particular parameter is used a priori to modify samples previously stored in memory. The best known representative of these methods is the conventional wave table synthesis.

Contrasting with this type of technique are the "parametric" synthesis methods which rely on the use of a model for manipulating a reduced number of parameters, compared to the number of signal samples produced in the non-parametric methods. The parametric synthesis techniques typically rely on additive, subtractive, source/filter or non-linear models.

Among these parametric methods, the term "mutual" can be used to qualify those that make it possible to jointly manipulate parameters corresponding to different sound sources, to then use only a single synthesis process, but for all the sources. In the so-called "sinusoidal" methods, typically, a frequency spectrum is constructed from parameters such as the amplitude and the frequency of each partial component of the overall sound spectrum of the sources. Indeed, an inverse Fourier transform implementation, followed by an add/overlap, provides an extremely effective synthesis of several sound sources simultaneously.

Regarding the spatialization of sound sources, different techniques are currently known. Some techniques (like "transaural" or "binaural") are based on taking into account HRTF transfer functions ("Head Related Transfer Function") representing the disturbance of acoustic waves by the morphology of an individual, these HRTF functions being specific to that individual. The sound playback is adapted to the HRTFs of the listener, typically on two remote loudspeakers ("transaural") or from the two earpieces of a headset ("binaural"). Other techniques (for example "ambiophonic" or "multichannel" (5.1 to 10.1 or above) are geared more towards a playback on more than two loudspeakers.

More specifically, certain HRTF-based techniques use the separation of the "frequency" and "position" variables of the HRTFs, thus giving a set of p basic filters (corresponding to the first p values specific to the covariance matrix of the HRTFs, of which the statistical variables are the frequencies), these filters being weighted by spatial functions (obtained by projection of the HRTFs on basic filters). The spatial functions can then be interpolated, as described in the document U.S. Pat. No. 5,500,900.

The spatialization of numerous sound sources can be performed using a multichannel implementation applied to the signal of each of the sound sources. The gains of the spatialization channels are applied directly to the sound samples of the signal, often described in the time domain (but possibly also in the frequency domain). These sound samples are processed by a spatialization algorithm (with applications of gains that are a function of the desired position), independently of the origin of these samples. Thus, the proposed spatialization could be applied equally to natural sounds and to synthetic sounds.

On the one hand, each sound source must be synthesized independently (with a time or frequency signal obtained), in order to be able to then apply independent spatialization gains. For N sound sources, it is therefore necessary to perform N synthesis calculations.

On the other hand, the application of the gains to sound samples, whether deriving from the time or frequency domain, requires at least as many multiplications as there are samples. For a block of Q samples, it is therefore necessary to apply at least N.M.Q gains, M being the number of intermediate channels (ambiophonic channels for example) and N being the number of sources.

Thus, this technique entails a high calculation cost in the case of the spatialization of numerous sound sources.

Among the ambiophonic techniques, the so-called "virtual loudspeaker" method makes it possible to encode the signals to be spatialized by applying to them gains in particular, the decoding being performed by convolution of the encoded signals by pre-calculated filters (Jérôme Daniel, "Représentation de champs acoustiques, application à la transmission et à la reproduction de scènes sonores complexes dans un contexte multimédia", [Representation of acoustic fields, application to the transmission and reproduction of complex sound scenes in a multimedia context], doctoral thesis, 2000).

A very promising technique, combining synthesis and spatialization, has been presented in the document WO-05/069272.

It consists in determining amplitudes to be assigned to signals representing sound sources, to define both the sound intensity (for example a "volume") of a source to be synthesized and a spatialization gain of this source. This document notably discloses a binaural spatialization with delays and gains (or "spatial functions") taken into account and, in particular, a mixing of the synthesized sources in the spatialization encoding part.

Even more particularly, an exemplary embodiment which is targeted in this document WO-05/069272 and in which the sources are synthesized by associating amplitudes with constitutive frequencies of a "tone" (for example a fundamental frequency and its harmonics) provides for synthesis signals to be grouped together by identical frequencies, with a view to subsequent spatialization applied to the frequencies.

This exemplary embodiment is illustrated in FIG. 1. In a synthesis block SYNTH (represented by broken lines), to frequencies $f_0, f_1, f_2, \ldots, f_p$ of each source to be synthesized $S_1, \ldots, S_N$ are assigned respective amplitudes $a_0^1, a_1^1, \ldots, a_p^1, \ldots, a_i^j, \ldots, a_0^N, a_1^N, \ldots, a_p^N$, in which, in the general notation $a_i^j$, j is a source index between 1 and N and i is a frequency index between 0 and p. Obviously, certain amplitudes of a set $a_0^j, a_1^j, \ldots, a_p^j$ to be assigned to one and the same source j can be zero if the corresponding frequencies are not represented in the tone of this source j.

The amplitudes $a_i^1, \ldots, a_i^N$ relating to each frequency $f_i$ are grouped together ("mixed") to be applied, frequency by frequency, to the spatialization block SPAT for an encoding applied to the frequencies (binaurally, for example, by then providing an inter-aural delay to be applied to each source). The signals of the channels $c_1, \ldots, C_k$, derived from the spatialization block SPAT, are then intended to be transmitted through one or more networks, or even stored, or otherwise dealt with, with a view to subsequent playback (preceded, where appropriate, by a suitable spatialization decoding).

This technique, although very promising, still warrants optimizations.

Generally, the current methods require significant calculation powers to spatialize numerous synthesized sound sources.

The present invention improves the situation.

SUMMARY OF THE INVENTION

To this end, it proposes a method for jointly synthesizing and spatializing a plurality of sound sources in associated spatial positions, the method comprising:

a) a step of assigning to each source at least one parameter representing an amplitude, b) a spatialization step implementing an encoding into a plurality of channels, wherein each amplitude parameter is duplicated to be multiplied by a spatialization gain, each spatialization gain being determined, on the one hand, for an encoding channel and, on the other hand, for a source to be spatialized, c) a step of grouping together the parameters multiplied by the gains, in respective channels, by applying a sum of said multiplied parameters to all the sources for each channel, and d) a parametric synthesis step applied to each of the channels.

Thus, the present invention to this end proposes first applying a spatialization encoding, then a "pseudo-synthesis", the term "pseudo" relating to the fact that the synthesis is applied in particular to the encoded parameters, derived from the spatialization, and not to usual synthetic sound signals. Indeed, a particular feature proposed by the invention is the spatial encoding of a few synthesis parameters, rather than performing a spatial encoding of the signals directly corresponding to the sources. This spatial encoding is applied more particularly to synthesis parameters which are representative of an amplitude, and it advantageously consists in applying to these few synthesis parameters spatialization gains which are calculated according to respective desired positions of the sources. It will thus be understood that the parameters multiplied by the gains in the step b) and grouped together in the step c) are not actually sound signals, as in the general prior art described hereinabove.

The present invention then uses a mutual parametric synthesis in which one of the parameters has the dimension of an amplitude. Unlike the techniques of the prior art, it thus exploits the advantages of such a synthesis to perform the spatialization. The combination of the sets of synthesis parameters obtained for each of the sources advantageously makes it possible to control as a whole the mutual parametric synthesis encoded blocks.

The present invention then makes it possible to simultaneously and independently spatialize numerous synthesized sound sources from a parametric synthesis model, the spatialization gains being applied to the synthesis parameters rather than to the samples of the time or frequency domain. This embodiment then provides a substantial saving on the calculation power required, because it involves a low calculation cost.

According to one of the advantages provided by the invention, since the number of steps in the synthesis is made independent of the number of sources, just one synthesis per intermediate channel can be applied. Whatever the number of sound sources, only a constant number M of synthesis calculations is provided. Typically, when the number of sources N becomes greater than the number M of intermediate channels, the inventive technique requires fewer calculations than the usual techniques according to the prior art. For example, with ambiophonic order 1 and in two dimensions (or three intermediate channels), the invention already provides a calculation gain for just four sources to be spatialized.

The present invention also makes it possible to reduce the number of gains to be applied. Indeed, the gains are applied to the synthesis parameters and not to the sound samples. Since the updating of the parameters such as the volume is generally less frequent than the sampling frequency of a signal, a calculation saving is thus obtained. For example, for a parameter update frequency (such as the volume in particular) of 200 Hz, a substantial saving on multiplications is obtained for a sampling frequency of the signal of 44 100 Hz (by a ratio of approximately 200).

The fields of application of the present invention can relate equally to the music domain (notably the polyphonic ringtones of cell phones), the multimedia domain (notably the soundtracks for video games), the virtual reality domain (sound scene rendition), simulators (engine noise synthesis), and others.

Other characteristics and advantages of the invention will become apparent from studying the detailed description hereinbelow, and the appended drawings in which, in addition to FIG. 1 relating to the prior art and described hereinabove:

DESCRIPTION OF PREFERRED EMBODIMENTS

Figure 1:
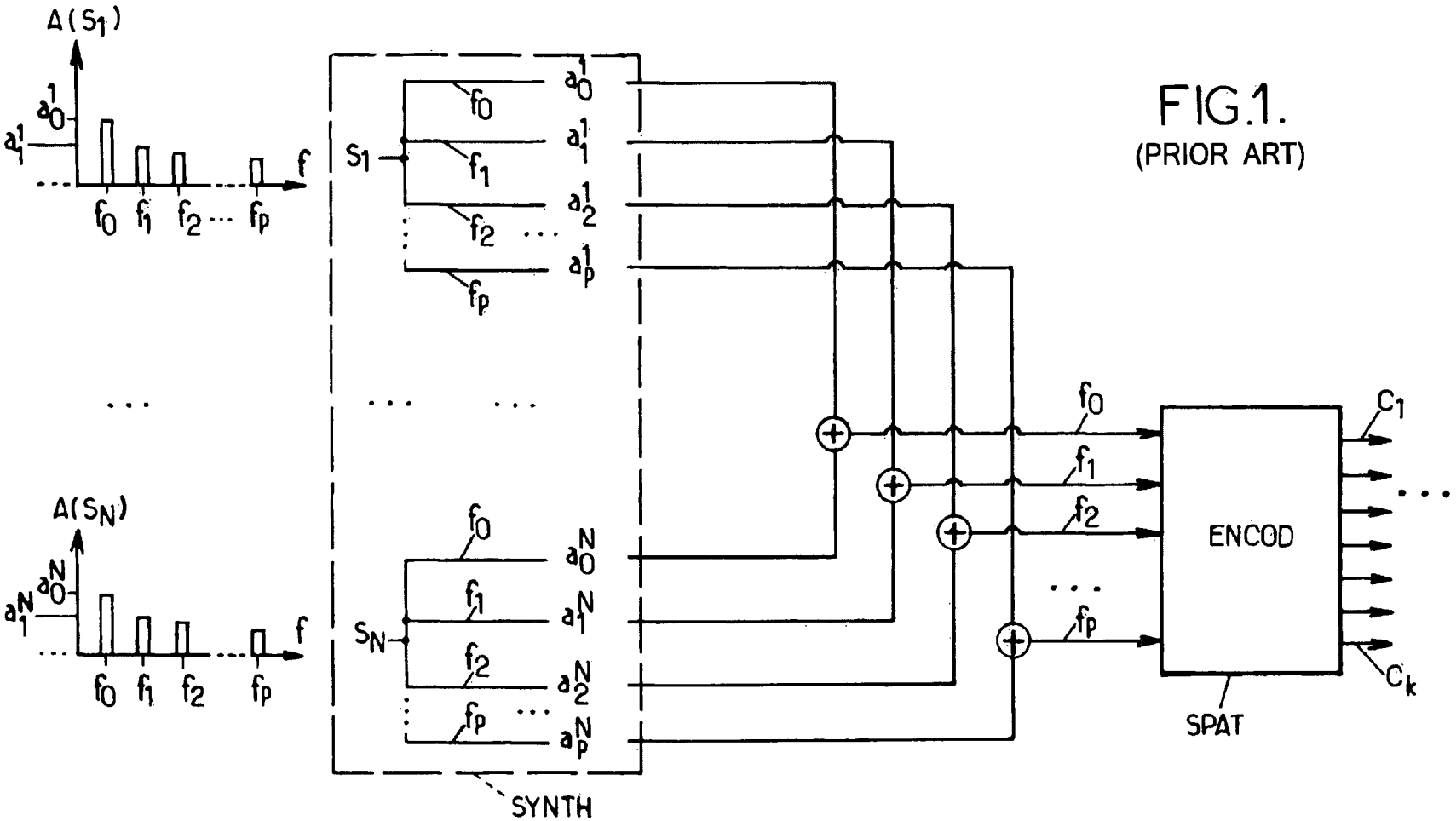
FIG.1. (PRIOR ART)
Figure 2:
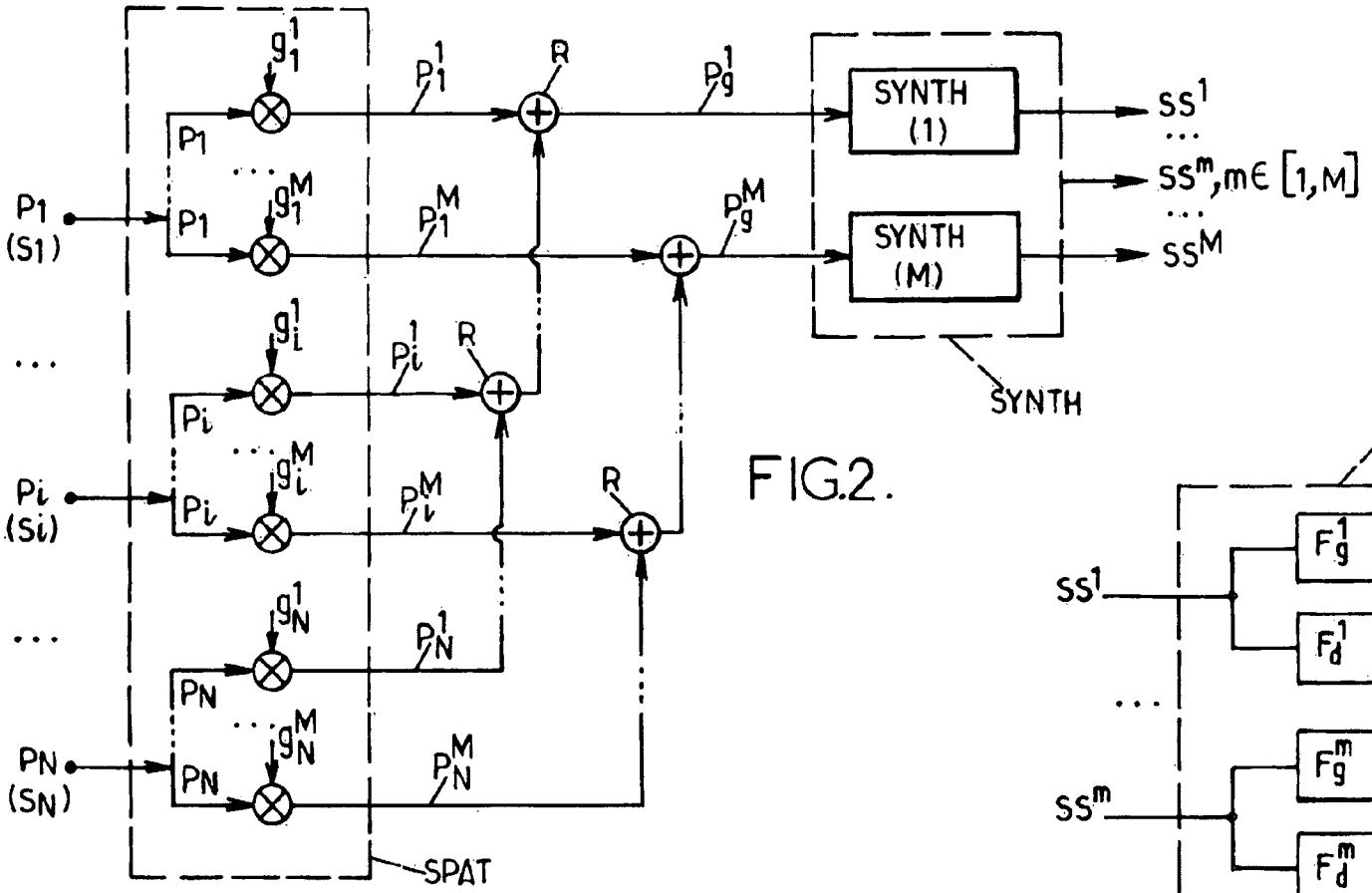
FIG. 2 illustrates the general spatialization and synthesis processing provided in a method according to the invention.

Referring to FIG. 2, at least one parameter $p_i$, representing an amplitude, is assigned to a source $S_i$ from among a plurality of sources $S_1, \ldots, S_N$ to be synthesized and spatialized (i being between 1 and N). Each parameter $p_i$ is duplicated into as many spatialization channels provided in the spatialization block SPAT. In the example represented where M encoding channels are provided for the spatialization, each parameter $p_i$ is duplicated M times to apply respective spatialization gains $g_i^1, \ldots, g_i^m$ (i being, as a reminder, a source index $S_i$).

There are then obtained N.M parameters each multiplied by a gain: $p_1g_1^1, \ldots, p_ig_1^M, \ldots, p_ig_i^1, \ldots, p_ig_i^M, \ldots, p_Ng_N^1, \ldots, p_Ng_N^M$.

These multiplied parameters are then grouped together (reference R in FIG. 2) on spatialization channels (M channels in all), or:

$p_1g_1^1, \ldots, p_ig_i^1, \ldots, p_Ng_N^1$ grouped together in a first spatialization channel $p_g^1$, and this, until:

$p_1g_1^M, \ldots, p_ig_i^M, \ldots, p_NG_N^M$ grouped together in an Mth spatialization channel $p_g^M$, the letter g of the index designating the term "global".

Thus, new parameters $p_i^m$ (i varying from 1 to N and m varying from 1 to M) are calculated by multiplying the parameters $p_i$ by the encoding gains $g_i^m$, obtained from the position of each of the sources. The parameters $p_i^m$ are combined (by summation in the example described) in order to provide the parameters $p_g^m$ which feed M mutual parametric synthesis blocks. These M blocks (referenced SYNTH(1) to SYNTH (M) in FIG. 2) make up the synthesis module SYNTH, which delivers M time or frequency signals $ss^m$ (m varying from 1 to M) obtained by synthesis from parameters $p_g^m$. These signals $ss^m$ can then feed a conventional spatial decoding block, as will be seen later with reference to FIG. 3.

In a particular embodiment, the synthesis used is an additive synthesis with application of an inverse Fourier transform (IFFT).

To this end, a set of N sources is characterized by a plurality of parameters $p_{i,k}$ representing the amplitude in the frequency domain of the kth frequency component for the ith source $S_i$.

The time signal $s_i(n)$ which would correspond to this source $S_i$, if it were synthesized independently of the other sources, would be given by:

$$s_i(n) = \sum_{k=1}^{K} c_{i,k}(n), \text{ with}$$

$$c_{i,k}(n) = p_{i,k}(n)\cos[2\pi f_{i,k}(n)n / F_e + \varphi_{i,k}(n)]$$

where $p_{i,k}$ is the amplitude of the frequency component $f_{i,k}$ and the phase of which is given by $\phi_{i,k}$ for the source $S_i$, at the instant n.

It is possible to produce the additive synthesis in the frequency domain from only the parameters $p_{i,k}$, $f_{i,k}$ and $\phi_{i,k}$ given, using for example the technique explained in the document FR-2 679 689.

The parameter $p_{i,k}$ represents the amplitude of a frequency component k given for a given source $S_i$. The parameters $p^m_{i,k}$ can therefore be deduced therefrom for each source, and each of the M channels using the relation:

$$p^m_{i,k} = g^m_i \cdot p_{i,k}, \text{ m varying from 1 to M.}$$

The gains $g^m_i$ are predetermined for a desired position for the source $S_i$ and according to the chosen spatialization encoding.

In the case of an ambiophonic encoding for example, these gains correspond to the spherical harmonics and can be expressed $g^m_i = Y_m(\theta_i, \delta_i)$, in which:

$Y_m$ is an mth order spherical harmonic, $\theta_i$ and $\delta_i$ are respectively the desired azimuth and bearing for the source $S_i$.

The parameters $p^m_{i,k}$ are then combined frequency by frequency, so as to obtain a single global parameter:

$$p^m_{g,k} = \sum_{i=1}^{N} p^m_{i,k},$$

in which k' describes all the frequencies $f_{i,k}$ present in all the sources $S_i$.

In practice, the value of k' is less than k.i because common frequencies can characterize several sources at a time. In one embodiment, provision may be made to associate one and the same global set of frequencies with all the sources, given that certain amplitude parameters for certain source frequencies are zero.

In this case, the values of k and k' are equal and the preceding relation is simply expressed:

$$p^m_{g,k} = \sum_{i=1}^{N} p^m_{i,k}$$

The synthesis step consists in using these parameters $p^m_{g,k}$ (m varying from 1 to M) to synthesize each of the M frequency spectra $ss^m(\omega)$ deriving from the synthesis module SYNTH. Provision may be made to this end to apply the technique described in FR-2 679 689, by iteratively adding spectral envelopes corresponding to the Fourier transform of a time window (for example Hanning), these spectral envelopes being previously sampled, tabulated, centered on the frequencies $f_k$ and then weighted by $p^m_{g,k}$, which is expressed:

$$ss^m(\omega) = \sum_{k=1}^{K} p^m_{g,k} \cdot env_k(\omega),$$

in which $env_k(\omega)$ is the spectral envelope centered on the frequency $f_k$.

Figure 4:
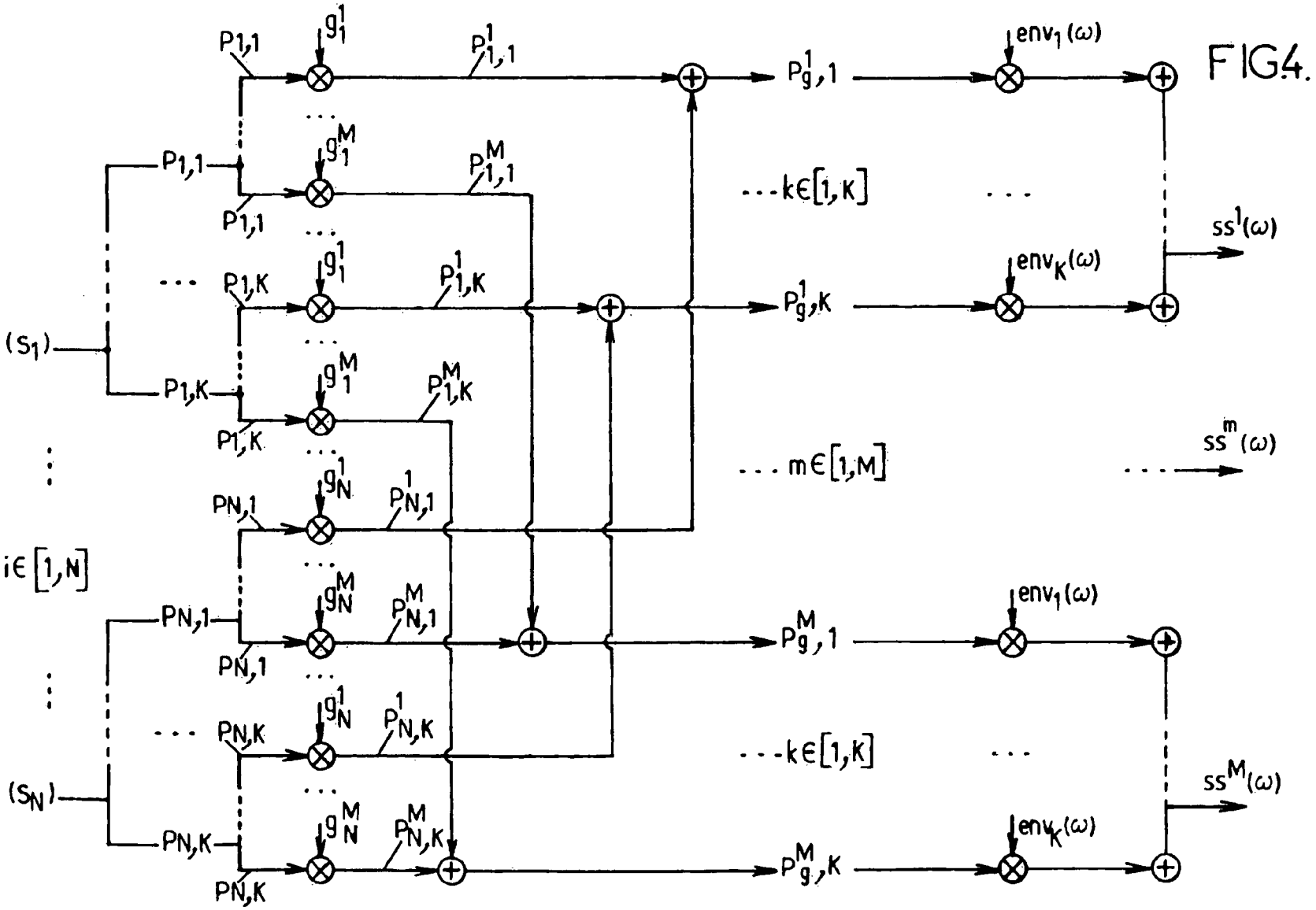
FIG. 4 illustrates a particular embodiment in which several amplitude parameters are assigned to each source, each parameter being associated with a frequency component.

This embodiment is illustrated in FIG. 4. K amplitude parameters $p_{i,k}$ are assigned to each source $S_i$. The source index i is between 1 and N. The frequency index k is between 1 and K. For each source $S_i$, these K parameters are duplicated M times, to be each multiplied by a spatialization gain $g_i^m$. The spatialization encoding channel index m is between 1 and M.

In each channel m, the K results of the products $g_i^m \cdot p_{i,k}$ are grouped together, frequency by frequency, according to the expression given hereinbelow:

$$p^m_{g,k} = \sum_{i=1}^{N} p^m_{i,k}, \text{ with } p^m_{i,k} = g^m_i \cdot p_{i,k},$$

where k varies from 1 to K in each channel m, and m varies globally from 1 to M.

It will thus be understood that, in each channel m, sub-channels $p^m_{g,k}$ are provided, each associated with a frequency component k, the index g designating, as a reminder, the term "global".

The processing then continues by multiplying the global parameter of each sub-channel $p^m_{g,k}$ associated with a frequency $f_k$ by a spectral envelope $env_k(\omega)$ centered on this frequency $f_k$, for all the K sub-channels (k between 1 and K), and globally, for all the M channels (m being between 1 and M). Then, the K sub-channels are summed in each channel m, according to the relation hereinbelow:

$$ss^m(\omega) = \sum_{k=1}^{K} p^m_{g,k} \cdot env_k(\omega),$$

for m ranging from 1 to M channels in total.

The signals $ss^m(\omega)$ are then obtained, encoded for their spatialization and synthesized according to the invention. They are expressed in the frequency domain.

To bring these M signals into the time domain (then denoted $SS^m(n)$), an inverse Fourier transform (IFFT) can then be applied to them:

$$SS^m(n)=\mathrm{IFFT}(ss^m(\omega))$$

The processing by successive frames can be performed by a conventional add/overlap technique.

Each of the M time signals $SS^m(n)$ can then be supplied to a spatialization decoding block.

Figure 3:
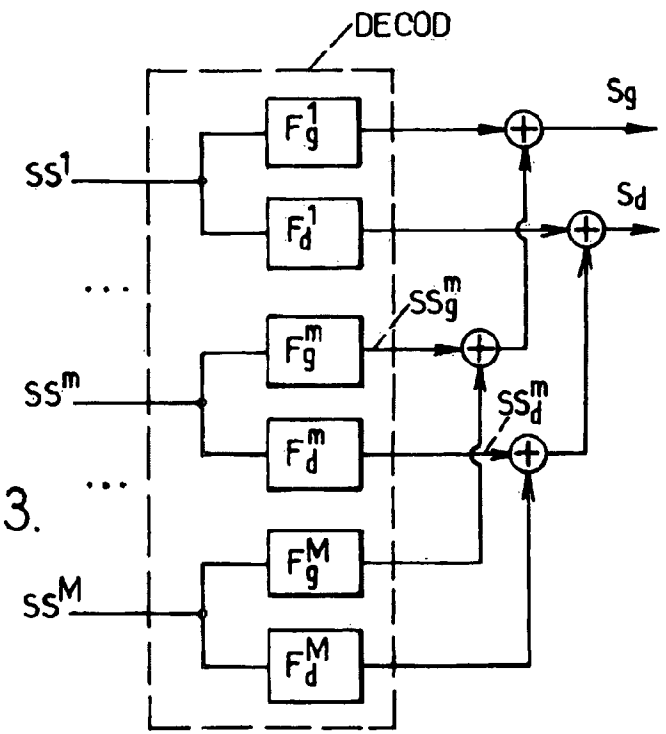
FIG. 3 illustrates a processing of the spatialized and synthesized signals, for a spatial decoding with a view to playback.

To this end, there may be provided, for example, a pair of matched filters $Fg^m(n)$, $Fd^m(n)$ to be applied, by convolution, to each signal $SS^m(n)$, as represented in FIG. 3, to adapt an ambiophonic encoding to a binaural playback with two channels, left and right. These filters for such an ambiophonic/binaural transition can be obtained by applying the virtual loudspeaker technique mentioned hereinabove.

The processing performed by the spatial decoding block DECOD of FIG. 3 can be of the type:

$$SS^m{}_g(n)=(SS^m*Fg^m)(n)$$

$$SS^m{}_d(n)=(SS^m*Fd^m)(n)$$

After filtering, all the signals intended for the left and right ears are respectively summed, and a pair of binaural signals is thus obtained:

$$S_g(n)=\sum_{m=1}^{M} SS_g^m(n)$$

$$S_d(n)=\sum_{m=1}^{M} SS_d^m(n)$$

which then feed the speakers of a headset with two earpieces.

There now follows a description of a more advantageous variant hereinbelow. The filters adapting the ambiophonic format to the binaural format can be applied directly in the frequency domain, so avoiding a convolution in the time domain and a corresponding calculation cost.

To this end, each of the M frequency spectra $ss^m(\omega)$ is directly multiplied by the respective Fourier transforms of the time filters, denoted $Fg^m(\omega)$ and $Fd^m(\omega)$ (adapted where appropriate to have a coherent number of points), which is expressed:

$$ss^m{}_g(\omega)=ss^m(\omega)\cdot Fg^m(\omega)$$

$$ss^m{}_d(\omega)=ss^m(\omega)\cdot Fd^m(\omega)$$

The spectra are then summed for each ear before performing the inverse Fourier transform and the add/overlap operation, or:

$$S_g(\omega)=\sum_{m=1}^{M} S_g^m(\omega)$$

$$S_d(\omega)=\sum_{m=1}^{M} S_d^m(\omega)$$

Then, to express the signals feeding the playback device in the time domain, the inverse Fourier transform is applied:

$$S_g(n)=\mathrm{IFFT}(s_g(\omega))$$

$$S_d(n)=\mathrm{IFFT}(s_d(\omega))$$

Figure 5:
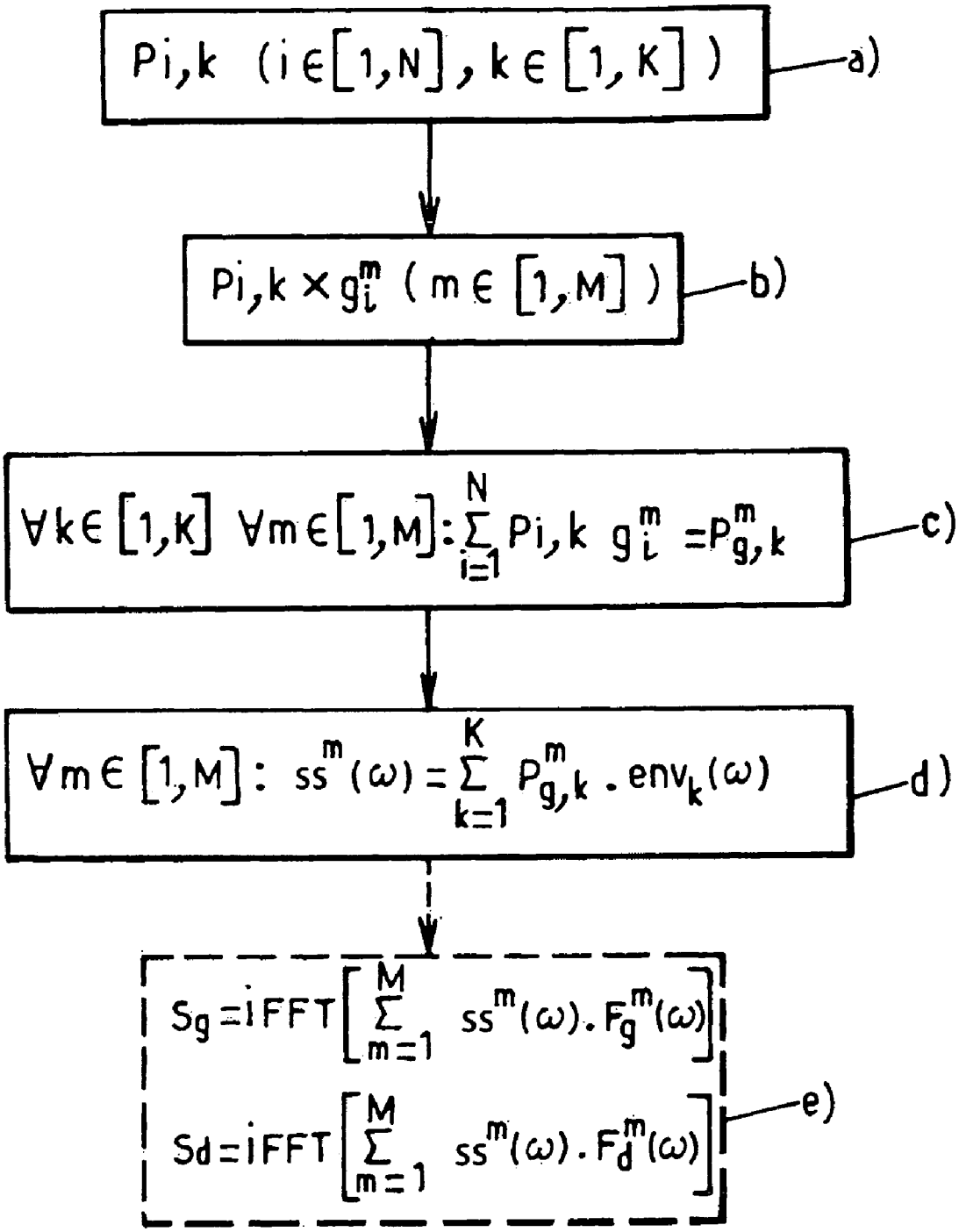
FIG. 5 illustrates the steps of a method according to the invention, and can correspond to a flow diagram of a computer program for implementing the invention.

The present invention also targets a computer program product, which may be stored in a memory of a central unit or of a terminal, or on a removable medium specifically for cooperating with a drive of this central unit (CD-ROM, diskette or other), or even downloadable via a telecommunication network. This program comprises in particular instructions for the implementation of the method described hereinabove, and a flow diagram of which can be illustrated by way of example in FIG. 5, summarizing the steps of such a method.

The step a) covers the assignment of the parameters representing an amplitude to each source $S_i$. In the example represented, a parameter $p_{i,k}$ is assigned for each frequency component $f_k$ as described hereinabove.

The step b) covers the duplication of these parameters and their multiplication by the gains $g_i^m$ of the encoding channels.

The step c) covers the grouping together of the products obtained in the step b), with, in particular, the calculation of their sum for all the sources $S_i$.

The step d) covers the parametric synthesis with multiplication by a spectral envelope $env_k$ as described hereinabove, followed by a grouping together of the sub-channels by application, in each channel, of a sum on all the frequency components (of index k ranging from 1 to K).

The step e) covers a spatialization decoding of the signals $ss^m$ deriving from the respective channels, synthesized, spatialized and represented in the frequency domain, for playback on two loudspeakers, for example, in binaural format.

The present invention also covers a device for generating synthetic and spatialized sounds, notably comprising a processor, and, in particular, a working memory specifically for storing instructions of the computer program product described hereinabove.

Of course, the present invention is not limited to the embodiment described hereinabove by way of example; it extends to other variants.

Thus, a spatialization encoding in ambiophonic format has been described hereinabove by way of example, performed by the module SPAT of FIG. 2, followed by an adaptation of the ambiophonic format to the binaural format. As a variant, provision can, for example, be made to directly apply an encoding to the binaural format.

Moreover, the multiplication by spectral envelopes of the parametric synthesis is described hereinabove by way of example; other models can be provided as a variant.

The invention claimed is:

1. A method for jointly synthesizing and spatializing a plurality of sound sources in associated spatial positions, comprising:

a) a step of assigning to each source at least one parameter representing an amplitude, b) a spatialization step implementing an encoding into a plurality of channels, wherein each amplitude parameter is duplicated to be multiplied with a spatialization gain, each spatialization gain being determined, on the one hand, for an encoding channel and, on the other hand, for a source to be spatialized, c) a step of grouping together the parameters multiplied by the gains, in respective channels, by applying a sum of said multiplied parameters to all the sources for each channel, and d) a parametric synthesis step applied to each of the channels.

2. The method as claimed in claim 1, wherein:

a) each source is assigned a plurality of parameters, each representing an amplitude of a frequency component, b) each amplitude parameter representing a frequency component is duplicated to be multiplied with a spatialization gain, each spatialization gain being determined, on the one hand, for an encoding channel and, on the other hand, for a source to be spatialized, c) in each channel, there are grouped together, frequency component by frequency component, the products of the parameters by the gains, into sub-channels each associated with a frequency component.

3. The method as claimed in claim 2, wherein the synthesis is conducted, in each channel, by:

d1) multiplying the output of each sub-channel associated with a frequency component by a spectral envelope centered on a frequency corresponding to said frequency component, d2) and grouping together, by a sum over the frequency components, the products resulting from the operation d1), to obtain, following the operation d2), a signal derived from each channel, spatially encoded and synthesized.

4. The method as claimed in claim 1, wherein the spatialization is conducted by ambiophonic encoding and the parameters representing an amplitude that are assigned to the sources correspond to spherical harmonic amplitudes.

5. The method as claimed in claim 2, wherein the spatialization is conducted by ambiophonic encoding and the parameters representing an amplitude that are assigned to the sources correspond to spherical harmonic amplitudes.

6. The method as claimed in claim 3, wherein the spatialization is conducted by ambiophonic encoding and the parameters representing an amplitude that are assigned to the sources correspond to spherical harmonic amplitudes.

7. The method as claimed in claim 6, wherein, to switch from an ambiophonic encoding to a decoding with a view to playback in binaural spatialization mode, a processing is applied in the frequency domain directly to the results of the products derived from the respective channels after the operation d2).

8. A computer program product, stored in a memory of a central unit or of a terminal, and/or on a removable medium specifically for cooperating with a drive of said central unit, and/or downloadable via a telecommunication network, characterized in that it comprises instructions for the implementation of the method as claimed in claim 1.

9. A module for generating spatialized synthetic sounds, notably comprising a processor, characterized in that it also comprises a working memory storing instructions of the computer program product as claimed in claim 8.

* * * * *